US008059066B2

(12) United States Patent
Ikeda

(10) Patent No.: US 8,059,066 B2
(45) Date of Patent: Nov. 15, 2011

(54) CURRENT-DRIVEN PIXEL CIRCUIT

(75) Inventor: Kyoji Ikeda, Gifu (JP)

(73) Assignee: Sanyo Electric Co., Ltd. (JP)

( * ) Notice: Subject to any disclaimer, the term of this patent is extended or adjusted under 35 U.S.C. 154(b) by 1691 days.

(21) Appl. No.: 11/132,960

(22) Filed: May 19, 2005

(65) Prior Publication Data

US 2005/0258775 A1 Nov. 24, 2005

(30) Foreign Application Priority Data

May 20, 2004 (JP) ..... 2004-150944

(51) Int. Cl.
*G09G 3/30* (2006.01)

(52) U.S. Cl. ..... 345/76; 345/82; 315/169.3

(58) Field of Classification Search ..... 345/76–83, 345/92, 173, 169.3; 315/169.3
See application file for complete search history.

(56) References Cited

U.S. PATENT DOCUMENTS

| | | | | |
|---|---|---|---|---|
| 6,501,466 | B1 | 12/2002 | Yamagishi et al. | |
| 6,859,193 | B1 | 2/2005 | Yumoto | |
| 2003/0001631 | A1* | 1/2003 | Huber et al. | 327/108 |
| 2003/0227262 | A1* | 12/2003 | Kwon | 315/169.3 |
| 2004/0066358 | A1* | 4/2004 | Numao | 345/76 |

FOREIGN PATENT DOCUMENTS

| | | | |
|---|---|---|---|
| JP | 2001147659 | | 5/2001 |
| JP | 2003-140612 | A | 5/2003 |
| JP | 2003-295824 | A | 10/2003 |
| JP | 2004-12897 | A | 1/2004 |
| JP | 2004-029791 | A | 1/2004 |
| JP | 2004012897 | | 1/2004 |
| WO | 01/06484 | A1 | 1/2001 |
| WO | WO 03/105117 | A2 | 12/2003 |

OTHER PUBLICATIONS

Notice of Grounds for Rejection for Japanese Patent Application No. 2004-150944 mailed Jul. 27, 2010 with English translation.

* cited by examiner

*Primary Examiner* — Lun-Yi Lao
*Assistant Examiner* — Insa Sadio
(74) *Attorney, Agent, or Firm* — Cantor Colburn LLP

(57) ABSTRACT

A write current is contracted without loss of precision of current-driven structure. While a capacitance TFT is switched off, a data current is supplied from a power supply line PVDD through a driver TFT and a selection TFT to a data line DL. With this process, a voltage which is lower than PVDD by an amount corresponding to a writing current of the driver TFT is set to gate of the driver TFT. Then, a control TFT is switched on so that a current corresponding to the gate voltage of the driver TFT flows to an organic electroluminescence element. In this process, the capacitance TFT is switched from an off state to an on state so that the gate voltage of the driver TFT changes corresponding to the change in capacitance and the drive current is contracted while the threshold value and mobility of the driver TFT are compensated for.

8 Claims, 7 Drawing Sheets

CURRENT-DRIVEN PIXEL CIRCUIT

CROSS-REFERENCE TO RELATED APPLICATIONS

The entire disclosure of Japanese Patent Application No. 2004-150944 including specification, claims, drawings and abstract is incorporated herein by reference.

BACKGROUND OF THE INVENTION

1. Field of the Invention

The present invention relates to a current-driven pixel circuit which controls a current for an organic electroluminescence (hereinafter simply referred to as "EL") element using a current data signal.

2. Description of the Related Art

Conventionally, a current-driven pixel circuit is known as a pixel circuit for driving an organic EL element. In the current-driven pixel circuit, a gate voltage of a driver transistor is set based on a current data signal while a corresponding current is applied to the driver transistor.

When a data voltage is simply set on the gate of the driver transistor, the drive current flowing through the driver transistor varies because of a variation in the threshold voltage among the driver transistors, resulting in a variation in light emission brightness of the organic EL element. With a current-driven pixel circuit, because the gate voltage of the driver transistor is set while a current corresponding to the current data signal is supplied through the driver transistor, it is possible to obtain relatively accurate drive current (see Japanese Patent Laid-Open Publication No. 2001-147659).

In a current-driven pixel circuit, in order to realize a minimum brightness, a voltage corresponding to a small data current signal must be set on the gate of the driver transistor, and therefore, there is a problem in that the time before setting becomes long.

Alternatively, there is another proposed method to drive the organic EL element with a contracted drive current by using a relatively large current data signal and setting a voltage corresponding to the current data signal on the gate of the driver transistor (see Japanese Patent Laid-Open Publication No. 2004-12897). In this method, however, it is not possible to apply a voltage corresponding to each driver transistor when the voltage is contracted and a constant voltage is applied. Therefore, there is a problem in that the error becomes large when the electron mobility varies among driver transistors.

SUMMARY OF THE INVENTION

According to the present invention, a gate voltage of a driver transistor is controlled by switching a capacitance transistor on and off. Because of this configuration, it is possible to realize current contraction corresponding to the characteristic of the driver transistor and precision of compensation with respect to variation in the threshold value and the precision of compensation with respect to variation in the mobility, which are advantages of a current-driven structure, are not lost.

In addition, by applying a sufficient forward bias to the capacitance transistor when the capacitance transistor is switched on, it is possible to sufficiently switch the driver transistor off to achieve a sufficient black level.

BRIEF DESCRIPTION OF THE DRAWINGS

Preferred embodiments of the present invention will be described in detail based on the following drawings, wherein.

DESCRIPTION OF PREFERRED EMBODIMENTS

Figure 1:
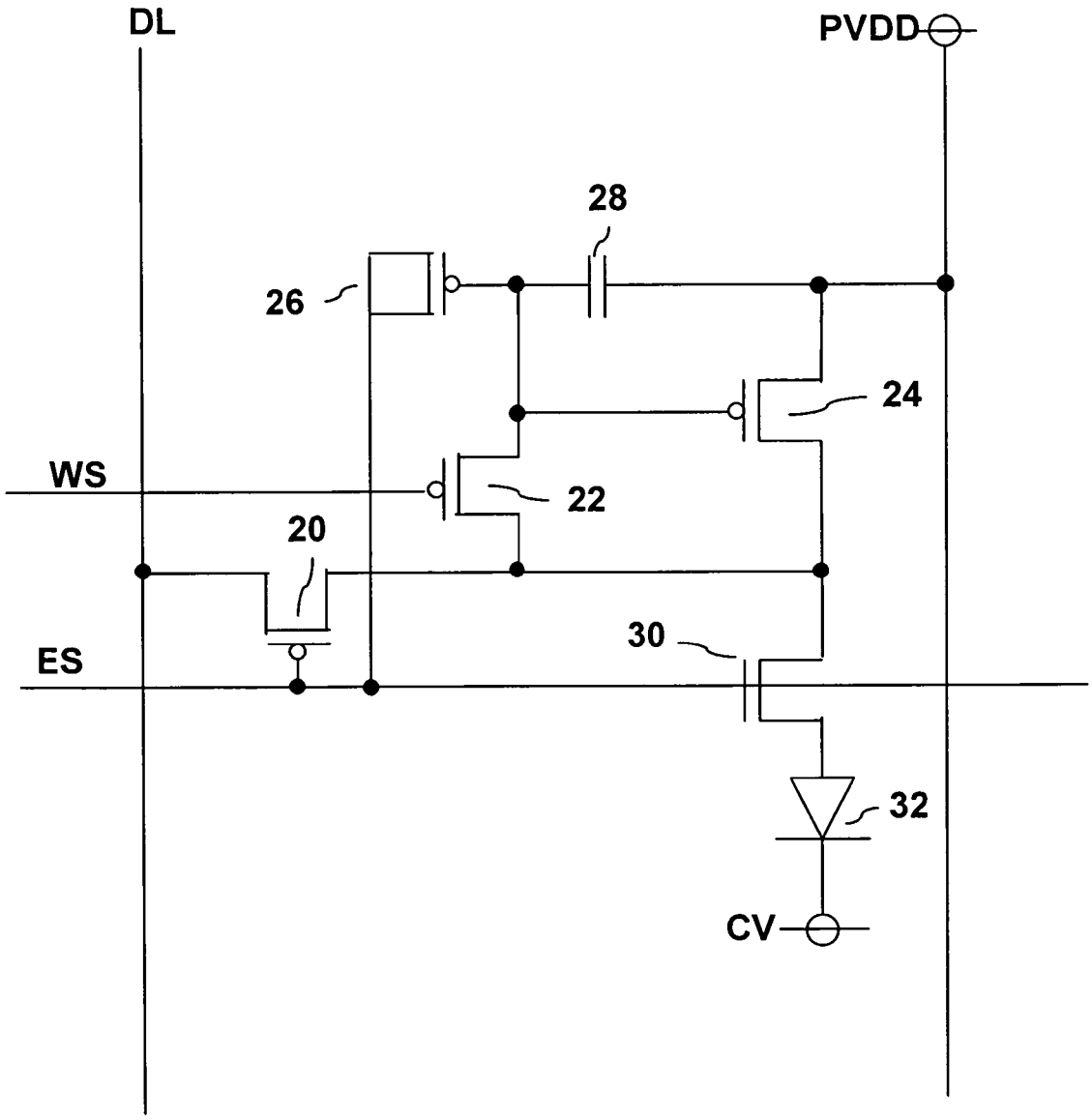
FIG. 1 is a diagram showing a structure of a pixel circuit according to a preferred embodiment of the present invention.

Preferred embodiments (hereinafter simply referred to as "embodiments") of the present invention will now be described referring to the drawings.

FIG. 1 is a circuit diagram showing a structure of a pixel circuit according to a preferred embodiment of the present invention. A drain of a p-channel selection TFT 20 is connected to a data line DL, a drain of a p-channel writing TFT 22 is connected to a source of the selection TFT 20, a control line ES is connected to a gate of the selection TFT 20, a source of the writing TFT 22 is connected to a gate of a p-channel driver TFT 24, and a gate of a p-channel capacitance TFT 26 is connected to the source of the writing TFT 22.

One or both of a source and a drain of the capacitance TFT 26 is connected to the control line ES. When only one of the source and drain is connected to the control line ES, the other one of the source and drain may be open.

The source of the writing TFT 22, the gate of the driver TFT 24, and the gate of the capacitance TFT 26 are connected to a power supply line PVDD through a storage capacitor 28. A source of the driver TFT 24 is connected to the power supply line PVDD and a drain of the driver TFT 24 is connected to the source of the selection TFT 20 and the drain of the writing TFT 22. Moreover, a drain of an n-channel control TFT 30 is connected to the drain of the driver TFT 24, an anode of an organic EL element 32 is connected to a source of the control TFT 30, and a cathode of the organic EL element 32 is connected to a cathode power supply CV.

Figure 7:
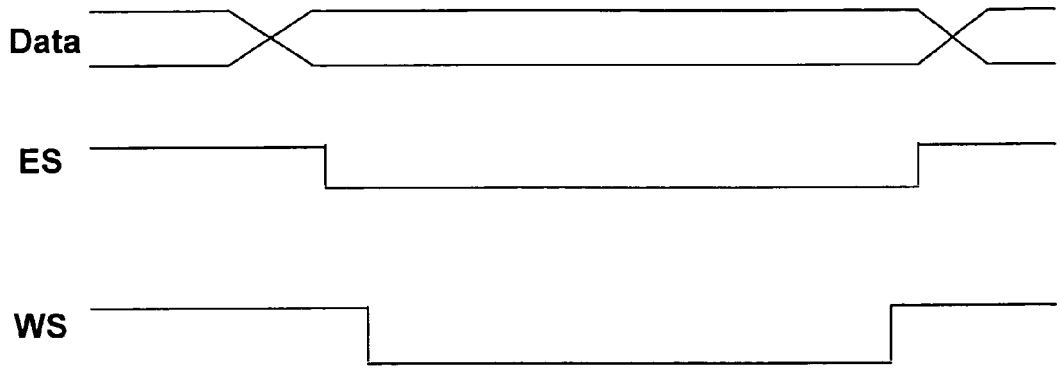
FIG. 7 is a diagram showing a timing of each signal in the circuit of FIG. 1.

As shown in FIG. 7, data signals are sequentially supplied on the data line DL for pixels of each row in a corresponding column. More specifically, the data signal sequentially supplies a designation current for each pixel along a horizontal scan direction (row direction) and is sequentially supplied to the corresponding data line DL.

When the data of the corresponding row is sequentially supplied to the data line DL, the control line ES is set to an L level for one horizontal period. A control line WS is set to an L level slightly after the control line ES is set to the L level and is set to an H level slightly before the control line ES is set to an H level. With this configuration, the writing TFT 22 is switched on only when the selection TFT 20 is at the ON state.

Therefore, at the time of writing of the corresponding row, first, the control lines WS and LS are set to the L level. With this process, the selection TFT 20 and the writing TFT 22 are switched on and the control TFT 30 is switched off. A data current (designation current; IDATA) corresponding to brightness is supplied to the data line DL. In the illustrated configuration, a predetermined data current is withdrawn from the data line DL.

Figure 2:
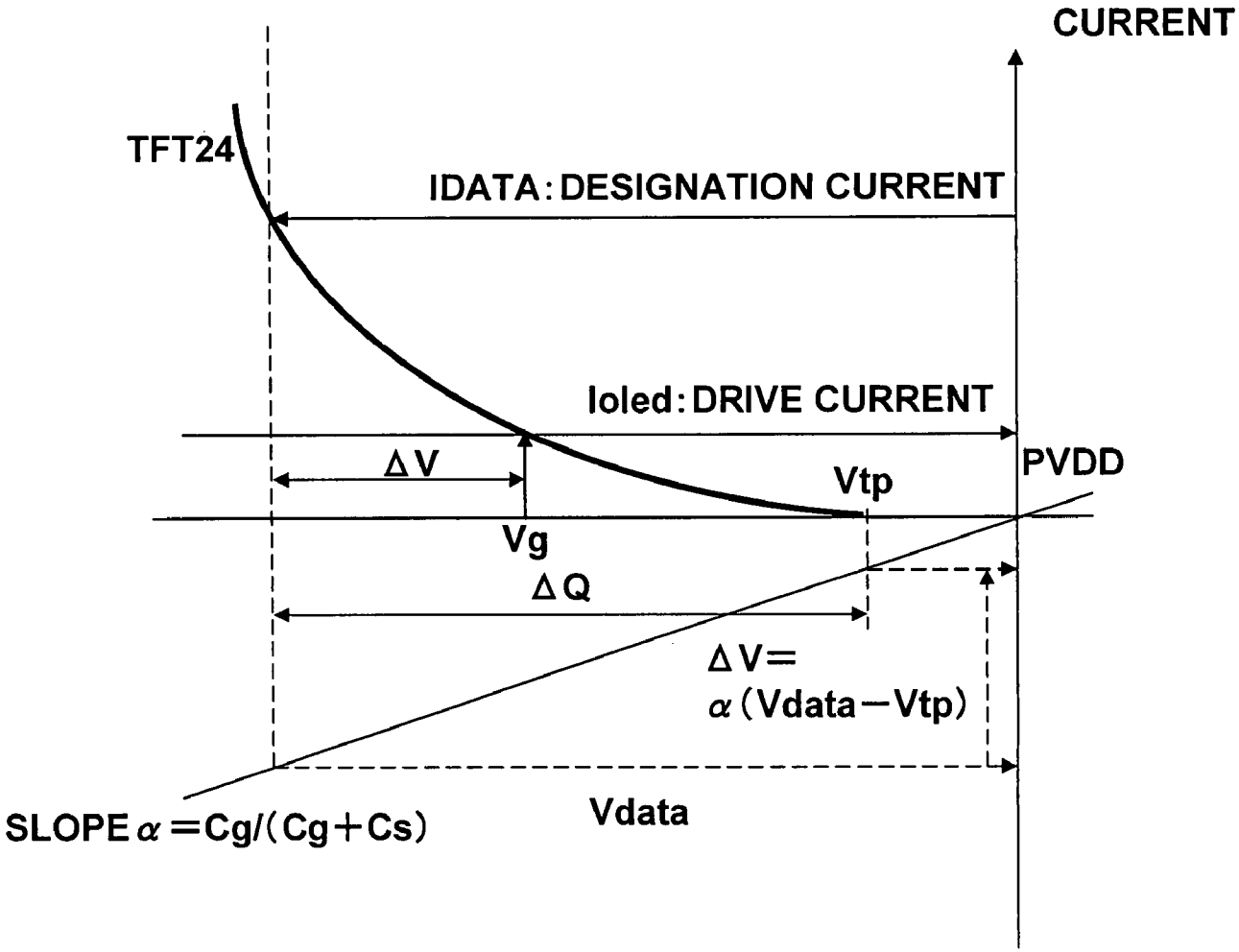
FIG. 2 is a diagram showing a relationship between a designation current and drive current.

Because the writing TFT 22 is in the ON state, the driver TFT 24 has its gate and drain connected (short-circuited), and therefore, the designation current IDATA flows through the driver TFT 24 which is diode connected and the selection TFT 20 which is in the ON state to the data line DL. In other words, the designation current IDATA flows to the driver TFT 24. As shown in FIG. 2, the gate voltage of the driver TFT 24 at this point is stored by the storage capacitor 28. The gate voltage is at a voltage which is lower than the voltage PVDD by a voltage Vdata corresponding to the current IDATA.

In this process, the control line ES is set at the L level and the gate of the capacitance TFT 26 is at a voltage which is sufficiently higher compared to the voltage on a terminal (for example, source) connected to the control line ES. Therefore, the capacitance TFT 26 is at the OFF state and Cg can be considered to be almost 0 and to have no charge.

More specifically, the gate voltage of the driver TFT 24 is a gate voltage when the data current (designation current) IDATA flows through the driver TFT 24 and is (PVDD−Vdata). Therefore, when the capacity of the storage capacitor 28 is Cs, charges in an amount of Cs·Vdata are charged to the storage capacitor Cs. On the other hand, when the L level voltage of the control line ES is set at 0 V, charges in an amount of Cg·(PVDD−Vdata)≈0 are charged to the capacitance TFT 26.

When setting of a gate potential of the driver TFT 24 is completed in this manner, the control line WS is set to the H level and then, the control line ES is set to the H level (for example, PVDD). With this process, the writing TFT 22 is switched off, and then the selection TFT 20 is switched on and the control TFT 30 is switched on.

Figure 3:
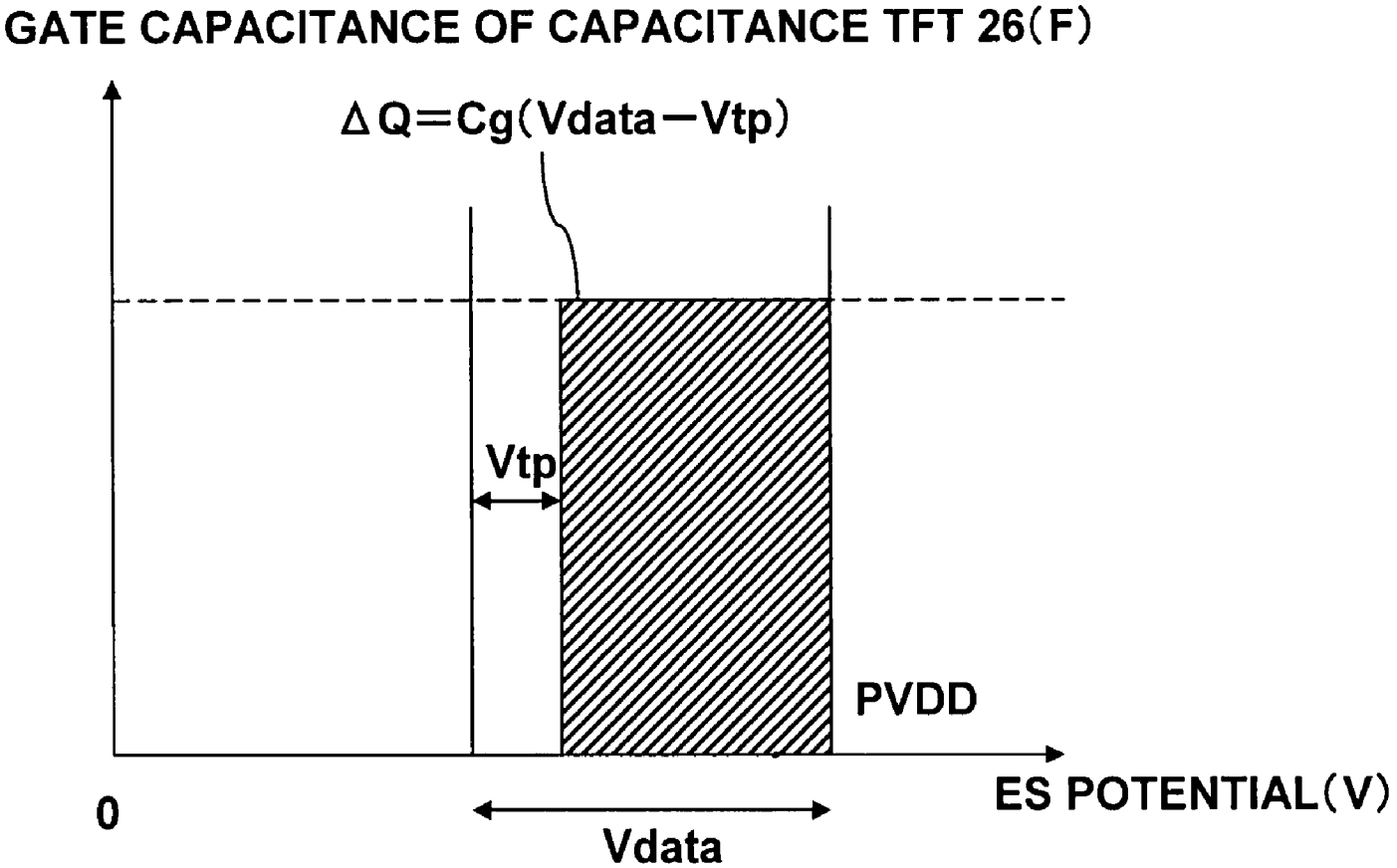
FIG. 3 is a diagram for explaining an amount of charges to be discharged.

A gate capacitance of the TFT starts to be generated when the potential on the control line ES becomes (PVDD−Vdata+|Vtp|) and accumulates charges until the control line ES becomes PVDD. The amount of charges in this process can be represented as shown in FIG. 3 and ΔQ=Cg (Vdata−|Vtp|). These charges are absorbed by the storage capacitor Cs and the capacitance Cg of the TFT 26 so that the gate voltage Vg' of the driver TFT 24 is determined.

Therefore, An amount of change of gate voltage ΔV=Vg−Vg' is:

$$\Delta V=\alpha(V\text{data}-Vtp)$$

wherein $\alpha=Cg/(Cg+Cs)$.

The gate voltage of the driver TFT 24 is therefore shifted by AV when the control line ES is set to PVDD. Therefore, a current loled which is reduced with respect to the designation current IDATA based on the value of αis withdrawn as a drive current loled of the driver TFT 24 and is supplied to the organic EL element 32.

According to the present embodiment, a current Ioled which is proportionally contracted from the designation current IDATA can be supplied to the organic EL element, which allows a configuration to set a large value for the designation current IDATA and to obtain a drive current which is contracted from the designation current IDATA, resulting in an increase in data writing speed.

In the present embodiment, a capacitance TFT 26 is utilized and ΔV is changed corresponding to the threshold voltage Vtp of the capacitance TFT 26. The capacitance TFT 26 can be easily formed near the driver TFT 24 and is a p-channel TFT similar to the driver TFT 24. Therefore, the threshold voltages of the capacitance TFT 26 and the driver TFT 24 can be easily set to the same voltage Vtp.

According to the present embodiment, with this configuration, the threshold voltage Vtp of the driver TFT 24 can be compensated for even when the threshold voltage Vtp of the driver TFT 24 varies among pixels. In addition, by using the capacitance TFT 26, it is possible to also compensate for variation in carrier mobility.

Figure 4:
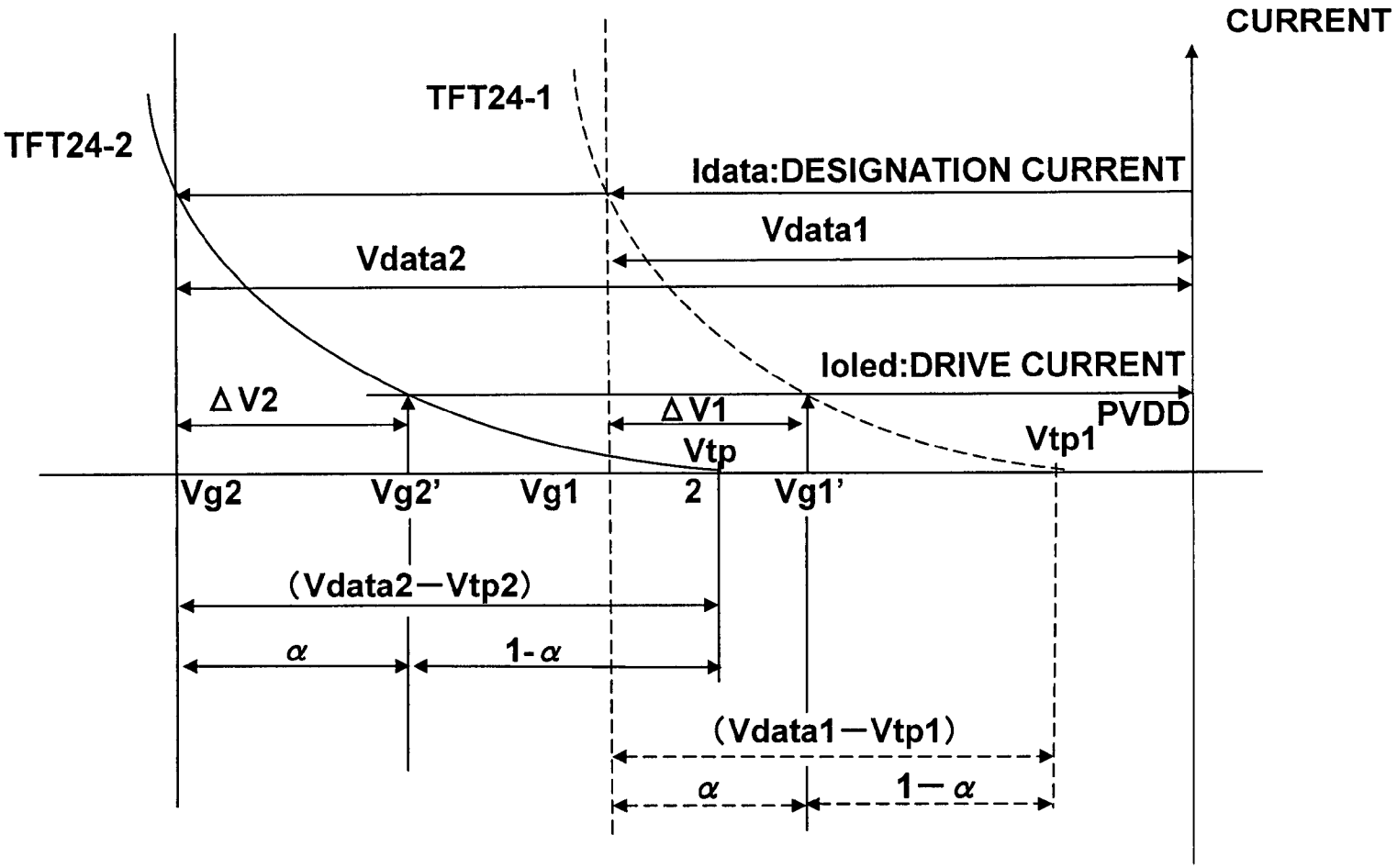
FIG. 4 is a diagram showing a relationship of designation current and drive current with respect to variation in threshold value.

More specifically, consider a case as shown in FIG. 4 in which two TFTs, TFT 24-1 and TFT 24-2, are provided as the driver TFT 24, with a transistor characteristic, that is, the threshold voltage, of the TFTs differing from each other and being Vtp1 and Vtp2 and a slope of drain current with respect to a change in the gate voltage (carrier mobility) differing from each other.

Because of the different characteristics, the gate voltages of the driver TFT 24 which are set with respect to the same designation current IDATA differ from each other and are Vdata1 for the TFT 24-1 and Vdata2 for the TFT 24-2. A drive region of the TFT 24-1 in this case is (Vdata1−Vtp1) and a drive region of the TFT 24-2 is (Vdata2−Vtp2). The potential shift ΔV1 and ΔV2 when the control line ES is set to the H level (which is at a voltage of PVDD or smaller) to switch the capacitance TFT 26 on are, respectively, ΔV1=α(Vdata1−Vtp1) and ΔV2=α(Vdata2−Vtp2), wherein α=Cg/(Cg +Cs). Therefore, the gate voltages Vg1' and Vg2' of the TFT 24-1 and TFT 24-2 which are set after the potential shift are at positions in which (Vdata1−Vtp1) and (Vdata2−Vtp2) are divided in a ratio of α: (1−α), and the corresponding drive current Ioled is identical in the TFT 24-1 and TFT 24-2 when α is identical. In other words, when values of the capacitance Cg of the capacitance TFT 26 and the storage capacitor Cs do not vary among pixels, the drive current Ioled does not vary even when the threshold value Vtp and carrier mobility (relationship between a gate-source voltage and drain current) of the driver TFT 24 varies among pixels.

As described, according to the present embodiment, variations in the threshold value and mobility of the driver TFT 24 can be compensated for, to achieve display with less variation.

In addition, in the circuit of the present embodiment, the control line ES is set to the H level to supply the drive current Ioled to the organic EL element 32. In the above-described embodiment, the control line ES is set to PVDD (or smaller), but the present invention is not limited to this configuration and the control line ES may alternatively be set to a voltage VVDD which is greater than or equal to the voltage PVDD.

When this configuration is employed, the gate voltage Vg of the driver TFT 24 which is set when the designation current IDATA flows is similar to that in the above-described configuration, but changes from Vg=(PVDD−Vdata) to Vg"=(VVDD−Vtp) because the control line ES is set to VVDD. Therefore, the amount of discharged charges, ΔQ, increases and the amount of change of the gate voltage, ΔV=Vg−Vg", increases.

Therefore, by increasing the value of VVDD, it is possible to reduce the drive current Ioled flowing through the driver TFT 24 and to achieve a drive current of 0 at a black level. In other words, it is possible to arbitrarily adjust the amount of offset of the driver TFT 24 by adjusting the H level voltage of the control line ES to reliably set the drive current Ioled to 0 during a black level.

Figure 5:
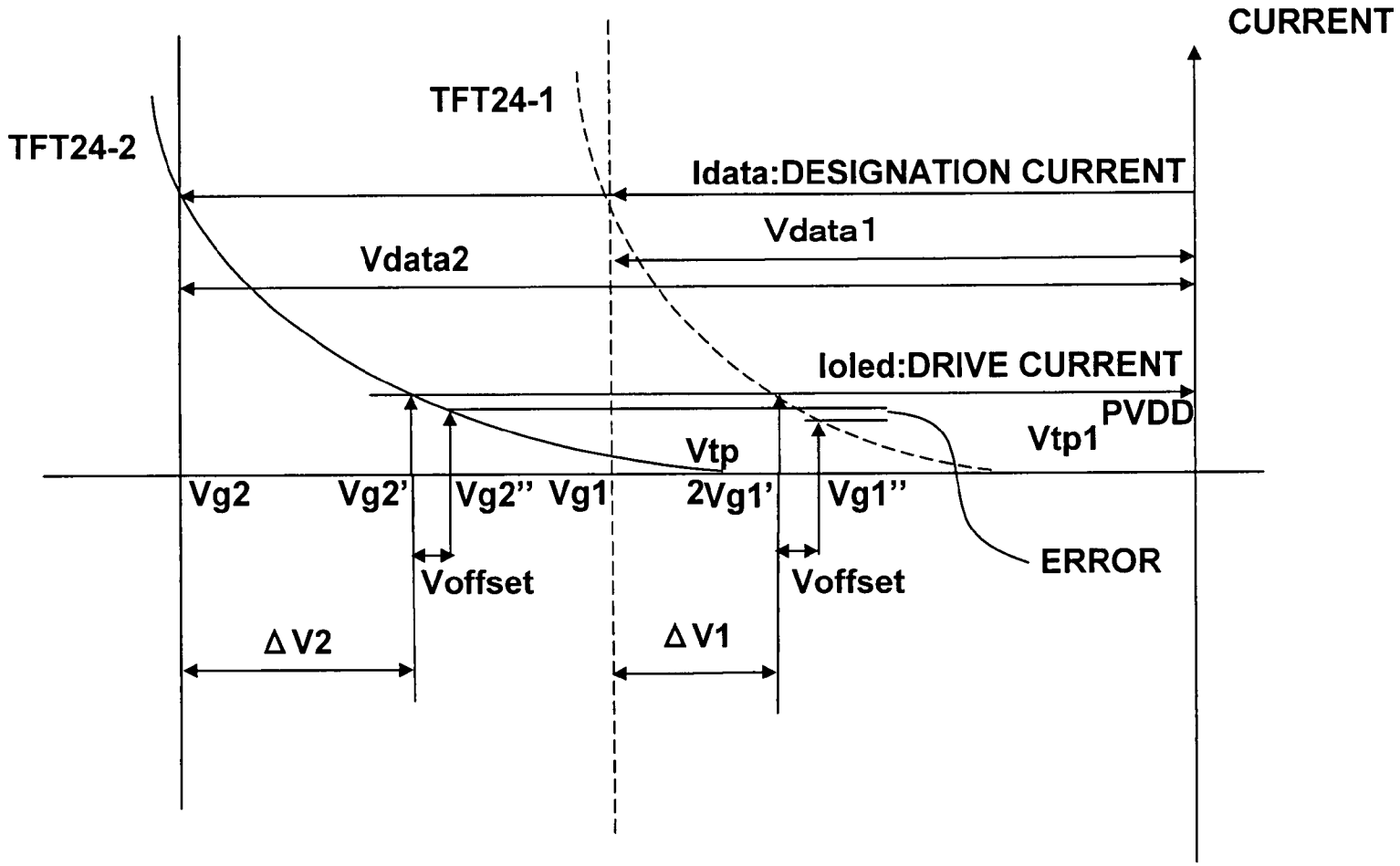
FIG. 5 is a diagram showing a relationship of designation current and drive current when the offset is increased.

More specifically, as shown in FIG. 5, by setting the control line ES to the voltage of the H level, the difference between the gate voltage Vg which is set with respect to the designation current IDATA and the actual gate voltage Vg" becomes ΔV+Voffset. By adjusting the voltage of the H level of the control line ES, it is possible to adjust the voltage Voffset to adjust the gate voltage Vg" which is actually set.

When the voltage of the H level of the control line ES is increased to a value greater than PVDD, the amount of charges discharged from the capacitance TFT 26 does not change corresponding to the threshold voltage, and Voffset is a constant. Therefore, there is a disadvantage that the effectiveness of compensation with respect to the variation in mobility among driver TFTs 24 becomes insufficient. More specifically, as shown in FIG. 5, when the slope in the voltage-current characteristic differs, the drive current Ioled with respect to the same designation current Idata would be different by an amount shown in FIG. 5 as an error. However, because this period is a period in which the voltage is at PVDD or greater and at VVDD or smaller, and is very short, it is preferable to employ this configuration in a current-driven structure in which it is important to achieve a current of 0 at the black level.

Figure 6:
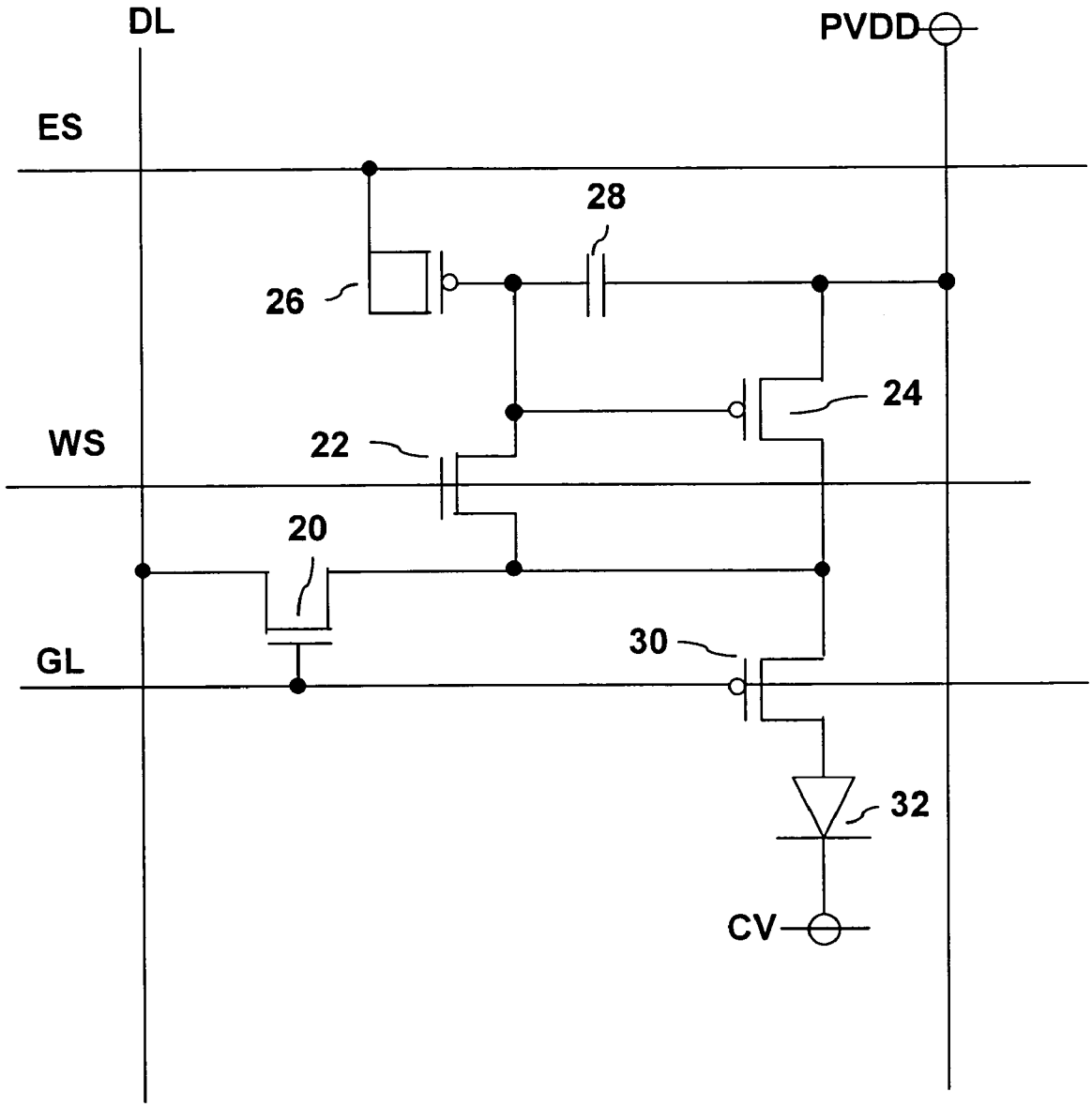
FIG. 6 is a diagram showing a structure of a pixel circuit according to another preferred embodiment of the present invention.

FIG. 6 shows a structure of another preferred embodiment of the present invention. In this embodiment, the control line ES is connected only to a source (and/or a drain) of the capacitance TFT 26 and is used solely for the control of the capacitance TFT 26. A gate line GL is connected to the gates of the selection TFT 20 and the control TFT 30. An n-channel TFT is employed as the selection TFT 20 and the writing TFT 22 and a p-channel TFT is employed as the control TFT 30.

Figure 8:
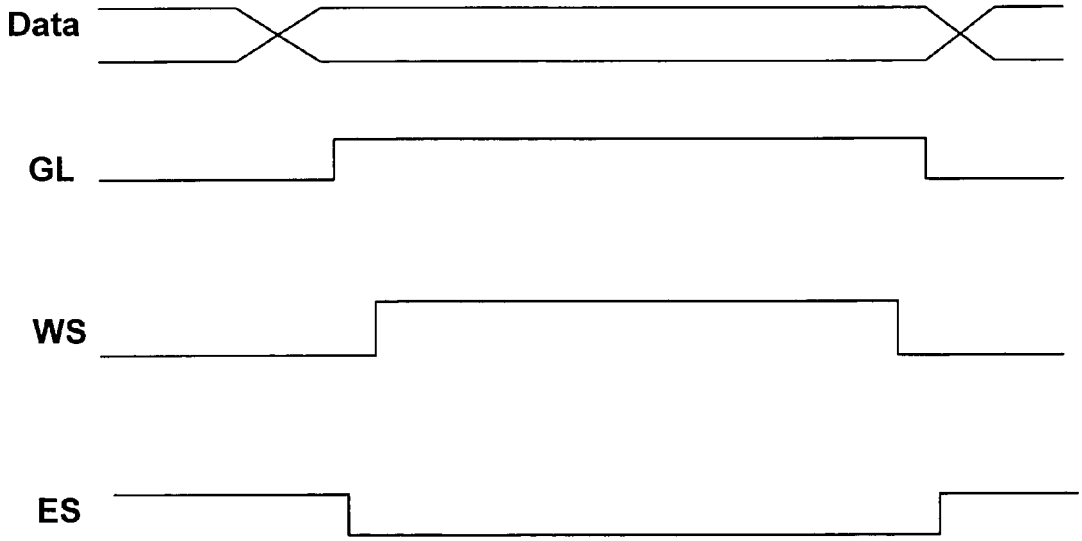
FIG. 8 is a diagram showing a timing of each signal in the circuit of FIG. 6.

As shown in FIG. 8, when data of a corresponding row are sequentially supplied to the data line DL, the gate line GL is set to an H level for one horizontal period. A control line WS is set to an H level slightly after the gate line GL is set to the H level and is set to an L level slightly before the gate line GL is set to an L level. With this configuration, the writing TFT 22 is switched on only during a period when the selection TFT 20 is in the ON state.

The control line ES is set to an H level during a period in which the gate line GL is at the L level. Therefore, although the timing itself is identical, the voltage of the H level is set to VVDD which is higher than PVDD. In this manner, it is possible to adjust the offset voltage Voffset as shown in FIG. 5. In particular, because the control line ES is provided solely for the capacitance TFT 26, it is possible to adjust the offset voltage without affecting the on/off states of the other TFTs.

What is claimed is:

1. A current-driven pixel circuit which controls a current for an organic electroluminescence element based on a current data signal, the pixel circuit comprising:

a driver transistor which supplies a current corresponding to a gate voltage of the driver transistor to the organic electroluminescence element; and a capacitance transistor having a gate connected to a gate of the driver transistor and a drain or a source connected to a control line, a storage capacitor which stores the gate voltage of the driver transistor and which is connected to the gate of the capacitance transistor;

wherein a voltage corresponding to a current data signal is set to the gate of the driver transistor while the capacitance transistor is at an OFF state and then a voltage on the control line is changed to switch the capacitance transistor on, so that the gate voltage of the driver transistor is shifted by charges accumulated in a capacitance generated in the capacitance transistor to reduce a current supplied to the organic electroluminescence element when the capacitance transistor is switched on.

2. A current-driven pixel circuit according to claim 1, wherein the capacitance transistor is a p-channel transistor.

3. A current-driven pixel circuit according to claim 1, wherein the driver transistor is connected to a power supply line; and a voltage of the control line at a high level is equal to or less than a voltage of the power supply line.

4. A current-driven pixel circuit according to claim 1, wherein the driver transistor is connected to a power supply line; and a voltage of the control line at a high level is greater than a voltage of the power supply line.

5. A current-driven pixel circuit which controls a current for an electroluminescence element based on a current data signal supplied on a data line, the pixel circuit comprising:

a selection transistor having a first terminal connected to a data line and a control terminal connected to a first control line;

a writing transistor having a first terminal connected to a second terminal of the selection transistor and a control terminal connected to a second control line;

a driver transistor having a control terminal connected to a second terminal of the writing transistor, a first terminal connected to a power supply line, and a second terminal connected to the second terminal of the selection transistor;

a control transistor having a first terminal connected to the second terminal of the driver transistor and a control terminal connected to a third control line;

an organic electroluminescence element which is connected to a second terminal of the control transistor and through which a drive current flowing through the driver transistor flows;

a storage capacitor which connects the control terminal of the driver transistor and the power supply line; the storage capacitor stores the gate voltage of the driver transistor and is connected to the gate of the capacitance transistor.

6. A current-driven pixel circuit according to claim 5, wherein the selection transistor is a transistor of an opposite polarity to that of the control transistor, and the first control line and the third control line are formed of one control line.

7. A current-driven pixel circuit according to claim 6, wherein the selection transistor is a transistor of the same polarity as that of the capacitance transistor, and the first control line, the third control line, and the fourth control line are formed of one control line.

8. A current-driven pixel circuit according to claim 5, wherein the fourth control line is set to a voltage which is higher than or equal to a voltage on the power supply line when the capacitance transistor is switched on.

* * * * *